US005388272A

United States Patent [19]

Epply

[11] Patent Number: 5,388,272

[45] **Date of Patent: * Feb. 14, 1995**

[54] METHOD OF MAKING A FOLDING HAT

[76] Inventor: William R. Epply, 1 Weatherby Rd., Hanover, N.H. 03755

[ * ] Notice: The portion of the term of this patent subsequent to Sep. 28, 2010 has been disclaimed.

[21] Appl. No.: 126,042

[22] Filed: Sep. 23, 1993

Related U.S. Application Data

[62] Division of Ser. No. 25,672, Mar. 3, 1993, Pat. No. 5,254,709.

[51] Int. Cl.[6] ..... A42C 1/00

[52] U.S. Cl. ..... 2/200.3; 2/175.1

[58] Field of Search ..... 2/171, 175.01, 175.1, 2/175.5, 195.1, 195.6, 195.7, 200.1, 200.3; 493/128, 151, 153, 243, 264, 937, 938

[56] References Cited

U.S. PATENT DOCUMENTS

| | | | |
|---|---|---|---|
| 878,219 | 2/1908 | Mann | 2/175.1 |
| 1,514,407 | 11/1924 | Thalimer | 2/175.1 |
| 2,000,242 | 5/1935 | Manning | 2/173 |
| 3,869,727 | 3/1975 | Hartman et al. | 2/175.1 |
| 5,071,401 | 12/1991 | Bertsch | 493/151 |
| 5,247,709 | 9/1993 | Epply | 2/200.3 |

FOREIGN PATENT DOCUMENTS

| | | | |
|---|---|---|---|
| 229175 | 1/1944 | Switzerland | 2/175.1 |

*Primary Examiner*—Clifford D. Crowder
*Assistant Examiner*—Diana L. Biefeld
*Attorney, Agent, or Firm*—James H. Grover

[57] ABSTRACT

A paper hat is formed from stiffly flexible paper-like material such as kraft with a rectangular top panel forming a crown, and four planar side panels and four planar side panels attached to the top panel along fold lines. The side panels have lower arcuate borders forming an oval, head-shaped opening toward the crown. Four arcuate panels flare from the side panels forming a brim with an ovate outer edge. One of the side panels has a transverse fold line parallel and intermediate the crown and the brim allowing the side panel to be folded flat. Additional fold lines along hinges joining the side panels and fold lines perpendicular to the crown allow the hat to be folded into a flat form with all panels in parallel planes.

12 Claims, 2 Drawing Sheets

METHOD OF MAKING A FOLDING HAT

This application is a division of pending application No. 08/025672, filed Mar. 3, 1993, now U.S. Pat. No. 5,254,709.

BACKGROUND OF THE INVENTION

Box-like paper hats have long been folded from newspapers by painters to protect their hair from dripping paint. Peaked paper hats have been folded for childrens' wear. Although spectators at outdoor sports may have an unexpected need for sun protection such prior paper hats lack brims and are not effective for inexpensive, disposable head protection.

It is the object of the present invention to provide an inexpensive, disposable but reasonably durable, hat which is conveniently carried for use as the need arises, which fits the head well and provides eye and face protection.

SUMMARY OF THE INVENTION

According to the invention a folding hat of stiffly flexible paper-like material comprises a top panel forming a crown, four planar side panels attached to the top panel along fold lines, the side panels having lower arcuate edges forming an oval, head-shaped opening toward the crown, and four arcuate brim panels flaring from the arcuate edges of the side panels to an ovate brim edge, one side panel having a fold line parallel to the crown and intermediate the crown and brim allowing the one side panel to be folded flat. Preferably the hat is folded from one sheet of water-repellent material with a rectangular crown and reinforced brim panels. Additional fold lines may be formed on two opposite side panels parallel to the crown and intermediate the crown and the arcuate edge; along two opposite side panels from the crown to the brim; and at hinges joining the side panels.

DRAWINGS

DESCRIPTION

Figure 2:
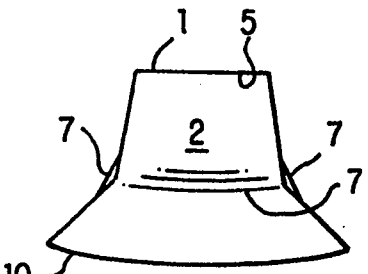
FIG. 2 is a front elevation of the hat.
Figure 3:
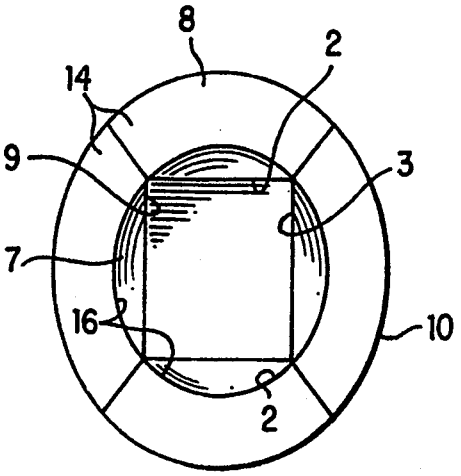
FIG. 3 is a bottom view of the hat.
Figure 1:
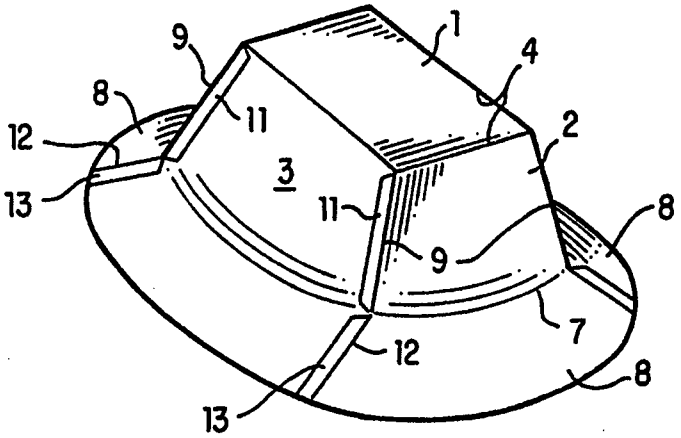
FIG. 1 is an isometric view of the hat according to the invention.

The present hat is shown in fully open condition in FIGS. 1 to 3, consisting of a single sheet of stiffly flexible paper-like material such as sixty to ninety pound test kraft paper. Non-woven fabrics or plastic sheet may be used. The outer surfaces of the hat are preferably made water repellent as with a silicone spray or an acrylic varnish for example, and may be colored or printed for special occasional uses, in which case bleached kraft paper is preferred.

The hat has a rectangular top panel 1 forming its crown. Integral with the top, crown panel are opposite front and rear side panels 2, and opposite lateral side panels 3, each integrally hinged to the crown 1 along fold lines 4 and extending to lower arcuate borders 7. Arcuate front and side brim panels 8 are integrally attached to the lower borders of the side panels 2 and 3 but not necessarily along a fold line. The brim extends to an outer ovate edge 10. The edges of the front and rear panels 2 and 3 are joined to each other along vertical fold lines 9 by adhesive hinges 11. Similarly the brim panels 8 are hinged to each other along fold lines 12 by adhesive tabs 13.

The circumference of the hat around the lower side panel borders 7 is less then that of the brim edge 10, and the undersides 14 of the brim panels are reinforced by a stiffening coat or layer of paper or the like which holds the brim flared out from the hat and provides a smooth transition between the generally planar faces 2 and 3 of the side panels and the conical faces of the brim panels 8. The stiff, flared brims thereby cause the lower borders 7 of the side panels to flare outwardly in the transition from the upper plane faces of the side panels. Consequently the brim panels tend to snap stiffly flared out for maximum shading effect, and additionally the inside periphery of the brim forms an oval, head-shaped opening 16 toward the crown (FIG. 3). The oval brim opening and flare of the side panels facilitates confirmation of the paper hat to the head and prevents the tendency of a paper hat to ride up on the head. The oval brim opening is conveniently dimensioned to supply graduated hat sizes.

Figure 4:
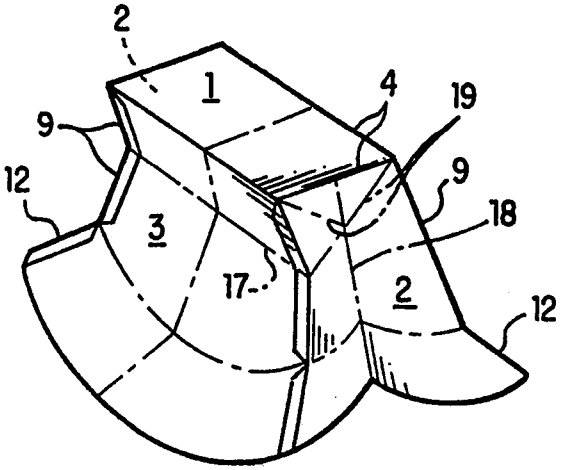
FIGS. 4 and 5 are isometric views showing the hat in progressive stages of folding.
Figure 7:
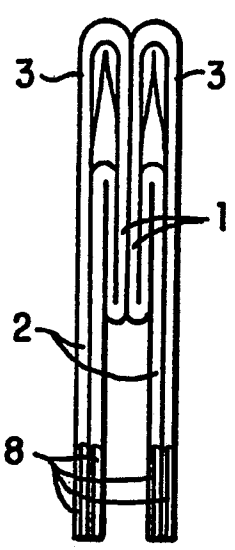
FIG. 7 is an edge view of the hat fully folded.
Figure 6:
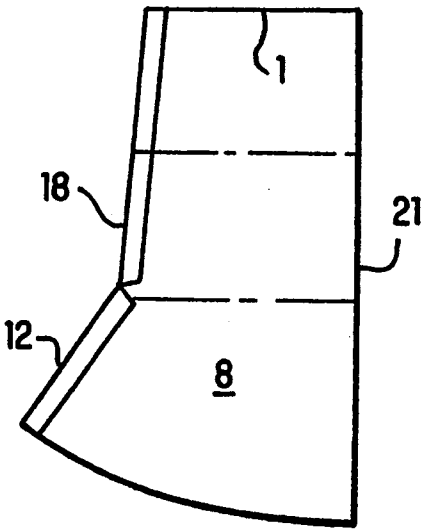
FIG. 6 is a side elevation of the hat fully folded.
Figure 5:
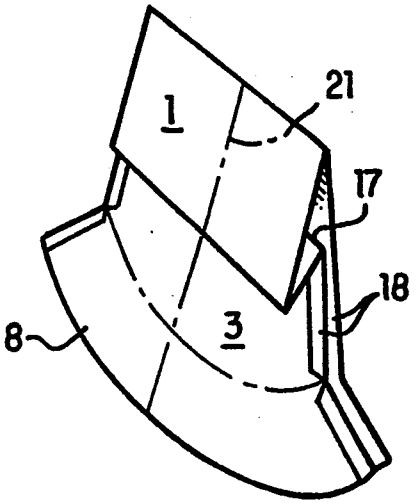

The paper hat as described is not only inexpensive yet comfortable and an efficient sun shade, but is adapted to be folded to a flat form easily stored in a pocket for wearing if the need arises. Successive folding ,stages are illustrated in FIGS. 4 to 7. In FIG. 4 the folding is started on one side panel 3 along a fold line 17 intermediate the crown 1 and parallel thereto. Simultaneously the front and rear side panels 2 and 3 fold along vertical lines 18 and diagonal lines 19 connecting the vertical lines 18 to the corners of the crown. The brim folds along its along its hinge lines 12. The folding continues along the same lines to the flattened form of FIG. 5. The folded hat may be stowed in this shape, or further folded on itself along a line 21 extending from the crown 1 to the brim 8 so that the, crown 1 and all the panels 1, 2, 3, and 8 lie in very compact parallel planes as shown in FIGS. 6 and 7.

It should be understood that the present disclosure is for the purpose of illustration only, and that the invention includes all modifications and equivalents falling within the appended claims.

I claim:

1. The method of making a folding paper hat comprising:

cutting a blank of stiffly flexible paper-like sheet material having a central rectangular crown with four side panels extending therefrom respectively to four arcuate brim panels;

connecting the side panels to each other along hinge lines extending from the crown to the brim; and connecting the brim panels to each other along fold lines flaring the brim panels outwardly of the side panels;

so that opposite side panels and the crown can be folded into flat parallel planes.

2. The method according to claim 1 wherein the blank is cut from a single sheet of material.

3. The method according to claim 1 wherein the side panels are cut to flare outwardly to their lower arcuate borders.

4. The method according to claim 1 including forming a fold line perpendicular to the crown extending between the crown and arcuate brim panels.

5. The method according to claim 4 including the step of forming fold lines diverging from the perpendicular fold line to the crown.

6. The method according to claim 1 wherein the brim is shaped with an ovate brim edge lying generally in a plane.

7. The method according to claim 1 wherein the side panels are flared outwardly to arcuate borders lying generally in a plane.

8. The method according to claim 1 including forming a brim with material stiffer than the crown and side panels.

9. The method according to claim 8 including adding a stiffening layer or coating to brim panels.

10. The method according to claim 9 wherein the stiffening layer or coating is formed on the underside of the brim.

11. The method according to claim 1 including folding the hat on a line along each of two opposite side panels extending from the crown to the brim, allowing the flattened hat to be folded again on itself.

12. The method according to claim 1 wherein the hat is formed of water repellent material.

* * * * *